US010745771B2

(12) United States Patent
Fujii et al.

(10) Patent No.: US 10,745,771 B2
(45) Date of Patent: Aug. 18, 2020

(54) METHOD FOR REFINING MOLTEN STEEL IN VACUUM DEGASSING EQUIPMENT

(71) Applicant: JFE STEEL CORPORATION, Tokyo (JP)

(72) Inventors: Yusuke Fujii, Tokyo (JP); Yoshie Nakai, Tokyo (JP); Naoki Kikuchi, Tokyo (JP); Naoya Shibuta, Tokyo (JP); Shinichi Nagai, Tokyo (JP); Takahiko Maeda, Tokyo (JP); Yuji Miki, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 209 days.

(21) Appl. No.: 16/079,712

(22) PCT Filed: Feb. 15, 2017

(86) PCT No.: PCT/JP2017/005391
§ 371 (c)(1),
(2) Date: Aug. 24, 2018

(87) PCT Pub. No.: WO2017/145877
PCT Pub. Date: Aug. 31, 2017

(65) Prior Publication Data

US 2019/0048431 A1 Feb. 14, 2019

(30) Foreign Application Priority Data

Feb. 24, 2016 (JP) ..... 2016-032620

(51) Int. Cl.
*C21C 7/10* (2006.01)
*C21C 7/064* (2006.01)
(Continued)

(52) U.S. Cl.
CPC ..... *C21C 7/10* (2013.01); *C21C 7/0037* (2013.01); *C21C 7/04* (2013.01); *C21C 7/064* (2013.01);
(Continued)

(58) Field of Classification Search
CPC ..... C21C 7/10; C21C 7/0037; C21C 7/04; C21C 7/064; C21C 7/0645; C21C 7/068; C21C 7/072
See application file for complete search history.

(56) References Cited

U.S. PATENT DOCUMENTS

2014/0311295 A1 10/2014 Uchida et al.

FOREIGN PATENT DOCUMENTS

CN 1084222 A 3/1994
EP 0 584 814 A2 3/1994
(Continued)

OTHER PUBLICATIONS

WO-2013137292-A1 english translation (Year: 2013).*
(Continued)

*Primary Examiner* — Anthony J Zimmer
*Assistant Examiner* — Ricardo D Morales
(74) *Attorney, Agent, or Firm* — Oliff PLC

(57) ABSTRACT

A molten steel refining method includes throwing a powder to molten steel while heating the powder with a flame formed by combustion of a hydrocarbon gas at the leading end of a top blowing lance. The lance height of the top blowing lance (the distance between the static bath surface of the molten steel and the leading end of the lance) is controlled to 1.0 to 7.0 m, and the dynamic pressure P of a jet flow ejected from the top blowing lance calculated from equation (1) below is controlled to 20.0 kPa or more and 100.0 kPa or less. $P=\rho_g \times U^2/2$ . . . (1) wherein P is the dynamic pressure (kPa) of the jet flow at an exit of the top
(Continued)

blowing lance, $\rho_g$ the density (kg/Nm$^3$) of the jet flow, and U the velocity (m/sec) of the jet flow at the exit of the top blowing lance.

4 Claims, 1 Drawing Sheet

(51) Int. Cl.

| | |
|---|---|
| ***C21C 7/072*** | (2006.01) |
| ***C21C 7/00*** | (2006.01) |
| ***C21C 7/068*** | (2006.01) |
| ***C21C 7/04*** | (2006.01) |

(52) U.S. Cl.
CPC ..... *C21C 7/068* (2013.01); *C21C 7/0645* (2013.01); *C21C 7/072* (2013.01)

(56) References Cited

FOREIGN PATENT DOCUMENTS

| | | | | | |
|---|---|---|---|---|---|
| JP | S58-73715 | A | | 5/1983 | |
| JP | S63-293109 | A | | 11/1988 | |
| JP | H01-92312 | A | | 4/1989 | |
| JP | H01-301815 | A | | 12/1989 | |
| JP | H02-47215 | A | | 2/1990 | |
| JP | H04-88114 | A | | 3/1992 | |
| JP | H05-239526 | A | | 9/1993 | |
| JP | H05-239534 | A | | 9/1993 | |
| JP | H05-311231 | A | | 11/1993 | |
| JP | 2972493 | B2 | | 11/1999 | |
| JP | 2001-316713 | A | | 11/2001 | |
| JP | 2003-41316 | A | | 2/2003 | |
| JP | 2003041316 | A | * | 2/2003 | ..... C21C 7/04 |
| JP | 2008-56992 | A | | 3/2008 | |
| JP | 2012-172213 | A | | 9/2012 | |
| JP | 2013-133520 | A | | 7/2013 | |
| JP | 5382275 | B1 | | 1/2014 | |
| WO | WO-2013137292 | A1 | * | 9/2013 | ..... C21C 7/10 |

OTHER PUBLICATIONS

JP-2003041316-A english translation (Year: 2005).*
Nov. 28, 2018 Extended European Search Report issued in European Application No. 17756317.8.
Apr. 15, 2020 Office Action issued in Chinese Patent Application No. 201780012818.7.
Mar. 3, 2020 Office Action issued in Korean Patent Application No. 2018-7024151.
May 16, 2017 International Search Report issued in International Patent Application No. PCT/JP2017/005391.
Sep. 8, 2017 Office Action issued in Taiwanese Application No. 160106181.
Aug. 20, 2019 Office Action issued in Chinese Application No. 201780012818.7.

* cited by examiner

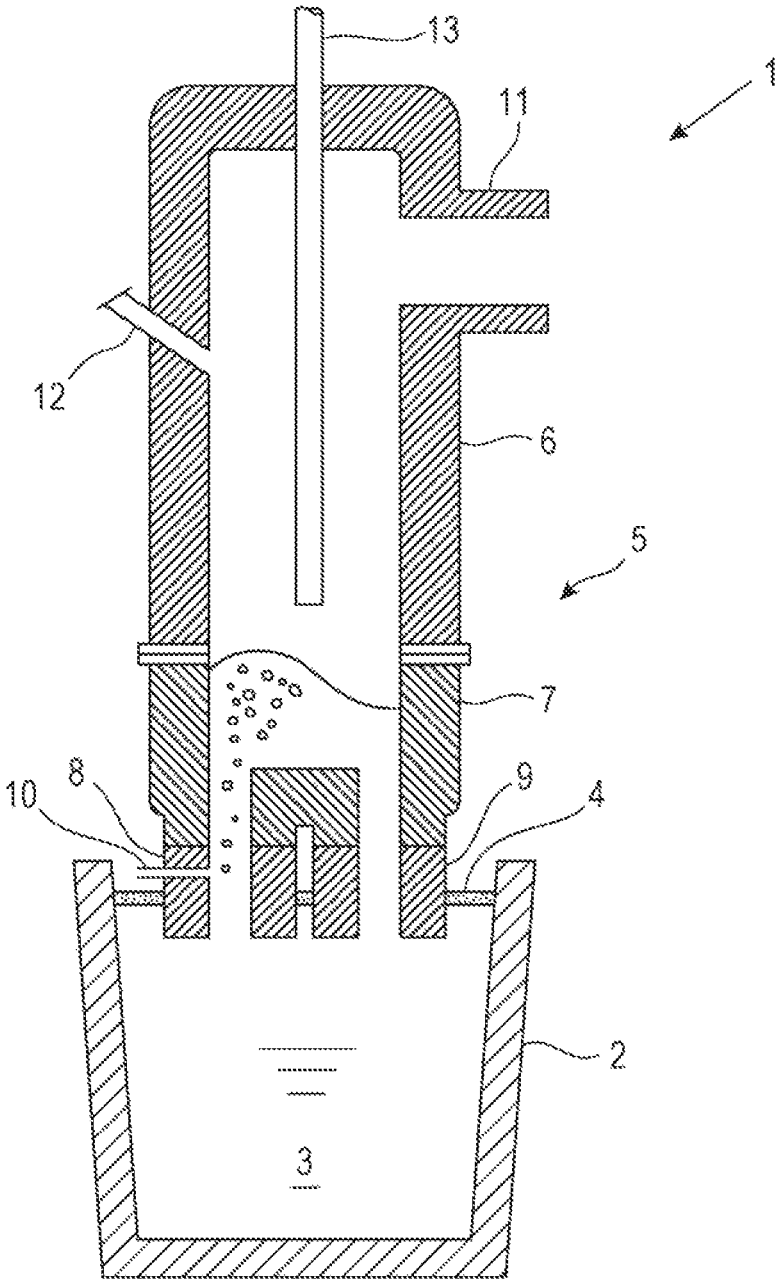
13
1
11
12
6
5
7
10
8
9
4
2
3

METHOD FOR REFINING MOLTEN STEEL IN VACUUM DEGASSING EQUIPMENT

TECHNICAL FIELD

The present disclosure relates to a molten steel refining method for smelting low-carbon high-manganese steel, low-sulfur steel, ultralow-sulfur steel or the like by throwing (blowing) powders such as manganese ore and CaO-based desulfurization agent to a bath surface of the molten steel under vacuum in vacuum degassing equipment from a top blowing lance while heating the powders with a flame formed at the leading end of the top blowing lance.

BACKGROUND ART

Recently, iron steel materials have gained use in diversified applications and have come to be frequently used in harsher environments than ever. Associated with this fact, demands on properties such as mechanical characteristics of steel products also have become severer than before. Under these circumstances, low-carbon high-manganese steel which possesses high strength and high workability has been developed for purposes of increasing strength of structural objects and reducing weight and cost thereof. The low-carbon high-manganese steel has been widely used in various fields such as steel sheets for line pipes and steel sheets for automobiles. Here, the "low-carbon high-manganese steel" refers to steel having a carbon concentration of 0.05 mass % or less and a manganese concentration of 0.5 mass % or more.

Cheap manganese sources include manganese ore or high-carbon ferromanganese, or the like, which are used in the steelmaking process to control the manganese concentration in molten steel. The smelting of low-carbon high-manganese steel involves throwing manganese ore as the manganese source into a converter; or adding high-carbon ferromanganese as the manganese source to molten steel being tapped from the converter, during decarburization refining of hot metal in the converter. Thus, the smelting increases the manganese concentration in molten steel to a predetermined concentration while cutting down cost associated with the manganese source (see, for example, Patent Literature 1).

However, in case of using these cheap manganese sources, reduction of the manganese ore leads to a failure to lower sufficiently the carbon concentration in molten steel through the decarburization refining in the converter, or the carbon present in high-carbon ferromanganese gives rise to an increase in carbon concentration in the molten steel that has been tapped. Thus, if there is a risk that the carbon concentration in molten steel will exceed the limit acceptable for low-carbon high-manganese steel, the molten steel that has been tapped needs to be further decarburized (refined).

As a known method for efficiently removing carbon from molten steel tapped from a converter, there is one decarburizing method which involves exposing the molten steel in a non-deoxidized state to a vacuum environment with use of vacuum degassing equipment such as an RH vacuum degassing apparatus; and decarburizing the steel by the reaction between dissolved oxygen contained in the molten steel (oxygen dissolved in the molten steel) and carbon in the molten steel. The alternative decarburization method involves blowing an oxygen source such as oxygen gas to molten steel under vacuum so as to oxidize carbon in the molten steel with the oxygen source thus supplied.

These decarburization methods under vacuum are called the "vacuum decarburization refining" in contrast to converter decarburization refining which takes place under atmospheric pressure. To remove carbon traced to a cheap manganese source by vacuum decarburization refining, for example, Patent Literature 2 proposes a method in which high-carbon ferromanganese is added into molten steel at an initial stage of vacuum decarburization refining in vacuum degassing equipment. Further, Patent Literature 3 proposes a method wherein high-carbon ferromanganese is added during the smelting of ultralow-carbon steel in vacuum degassing equipment, the addition taking place by the time when 20% of the vacuum decarburization refining time passes. In the vacuum decarburization refining of molten steel containing a large amount of manganese, however, oxygen reacts not only with carbon in the molten steel but also with manganese in the molten steel, with the result that the manganese added is lost by oxidation and the manganese yield is decreased. Further, the reaction makes it difficult to control the manganese content in the molten steel with good accuracy.

Regarding the oxygen source and the approach to promoting decarburization reaction in vacuum decarburization refining, for example, Patent Literature 4 proposes a method in which solid oxygen such as mill scale is added into a vacuum vessel to allow decarburization reaction to occur preferentially while suppressing the oxidation of manganese. Patent Literature 5 proposes a method wherein molten steel is refined by vacuum decarburization in such a manner that the converter blowing is terminated at a controlled carbon concentration in the molten steel and at a controlled temperature of the molten steel, and manganese ore is added to such molten steel in a vacuum degassing apparatus.

Patent Literatures 6 and 7 propose methods wherein molten steel tapped from a converter is refined by vacuum decarburization with an RH vacuum degassing apparatus in such a manner that a MnO powder or a manganese ore powder is top-blown together with a carrier gas toward the surface of the molten steel in a vacuum vessel. Patent Literature 8 proposes a vacuum decarburization refining method wherein a manganese ore powder is blown into molten steel in a vacuum vessel of an RH vacuum degassing apparatus together with a carrier gas through nozzles disposed on the sidewall of the vacuum vessel to decarburize the molten steel by means of oxygen in the manganese ore and also to increase the manganese concentration in the molten steel.

Meanwhile, there have been increasing demands for enhanced material characteristics in association with the increase in added values and the widening of applications of iron and steel materials. One approach to meeting such demands is to increase the purity of steel, specifically, to desulfurize molten steel to an ultralow level.

The smelting of low-sulfur steel generally performs desulfurization at a hot metal stage where the desulfurization reaction attains high efficiency. However, it is difficult for the desulfurization at the hot metal stage alone to attain sufficient reduction in sulfur concentration to the desired content of 0.0024 mass % or less for low-sulfur steel or 0.0010 mass % or less for ultralow-sulfur steel. Thus, the manufacturing of low-sulfur steel with a sulfur content of 0.0024 mass % or less or ultralow-sulfur steel with a sulfur content 0.0010 mass % or less involves desulfurization not only at the hot metal stage but also after the molten steel has been tapped from the converter.

Numerous methods have been heretofore proposed for the desulfurization of molten steel tapped from a converter, with examples including injection of a desulfurization agent to molten steel in a ladle, and addition of a desulfurization agent to molten steel in a ladle followed by stirring of the molten steel and the desulfurization agent. These methods, however, add a new step (a desulfurization step) between the tapping of steel from a converter and the treatment in vacuum degassing equipment, and thus cause problems such as temperature drop of molten steel, increase in production costs, and decrease in productivity.

To solve these problems, attempts have been made in which a desulfurization function is incorporated into vacuum degassing equipment to bring together and simplify secondary refining steps. For example, Patent Literature 9 proposes a method for the desulfurization of molten steel using vacuum degassing equipment wherein molten steel is introduced into a vacuum vessel of an RH vacuum degassing apparatus equipped with a top blowing lance, and a CaO-based desulfurization agent is thrown (blown) together with a carrier gas from the top blowing lance onto the bath surface to desulfurize the molten steel.

When, however, an oxide powder such as manganese ore for smelting low-carbon high-manganese steel or a CaO-based desulfurization agent for desulfurization is thrown from a top blowing lance during refining in vacuum degassing equipment, the temperature of molten steel is decreased by the sensible heat and latent heat of the oxide powder that is thrown or by the decomposition heat required for thermal decomposition. Such a temperature drop of molten steel is compensated for by an approach such as to increase beforehand the molten steel temperature in a step upstream of the vacuum degassing equipment, or to add metallic aluminum to the molten steel during refining in the vacuum degassing equipment to use the combustion heat of aluminum to raise the molten steel temperature. However, the approach which involves increasing of the molten steel temperature in a step upstream of the vacuum degassing equipment is accompanied by significant wear and damage of refractory materials in the preceding step, and brings about an increase in cost. The approach to increasing the temperature by the addition of metallic aluminum in the vacuum degassing equipment is disadvantageous in that, for example, the cleanliness of molten steel is deteriorated due to the resulting aluminum oxide, and the cost of auxiliary materials is increased.

Methods have been then proposed which involves throwing an oxide powder while suppressing a temperature drop of molten steel. For example, Patent Literature 10 proposes a method in which an oxide powder such as manganese ore is thrown onto the bath surface of molten steel while being heated by a flame of a burner disposed at the leading end of a top blowing lance. Further, Patent Literatures 11 and 12 propose methods in which molten steel is desulfurized with a CaO-based desulfurization agent thrown from a top blowing lance in such a manner that oxygen gas and combusting gas are jetted together from the top blowing lance so as to form a flame at the leading end of the top blowing lance, and the CaO-based desulfurization agent, after being heated and melted with the flame, is delivered to the bath surface of the molten steel.

The above refining methods have an object of enhancing the reaction rate and increasing the temperature of molten steel by heating powders such as manganese ore and a CaO-based desulfurization agent with a flame formed at the leading end of the top blowing lance in the vacuum degassing equipment, the powders heated being thus delivered to the molten steel. In this type of a refining method, the dynamic pressure of the jet flow ejected from the top blowing lance affects not only the yield of manganese ore and the desulfurization efficiency of the CaO-based desulfurization agent, but also affects the efficiency of heat transfer mediated by the powders. That is, if the jet flow is ejected from the top blowing lance without appropriate controlling of its dynamic pressure, the effect of the flame cannot be taken advantage of sufficiently. However, the conventional techniques including those described in Patent Literatures 10, 11 and 12 do not specify the dynamic pressure with which the jet flow is to be ejected from the top blowing lance.

CITATION LIST

Patent Literature

PTL 1: Japanese Unexamined Patent Application Publication No. 4-88114

PTL 2: Japanese Unexamined Patent Application Publication No. 2-47215

PTL 3: Japanese Unexamined Patent Application Publication No. 1-301815

PTL 4: Japanese Unexamined Patent Application Publication No. 58-73715

PTL 5: Japanese Unexamined Patent Application Publication No. 63-293109

PTL 6: Japanese Unexamined Patent Application Publication No. 5-239534

PTL 7: Japanese Unexamined Patent Application Publication No. 5-239526

PTL 8: Japanese Unexamined Patent Application Publication No. 1-92312

PTL 9: Japanese Unexamined Patent Application Publication No. 5-311231

PTL 10: Japanese Patent No. 5382275

PTL 11: Japanese Patent No. 2972493

PTL 12: Japanese Unexamined Patent Application Publication No. 2012-172213

SUMMARY

Technical Problem

The present disclosure has been made in light of the circumstances discussed above. It is therefore an object of the present disclosure to provide a method for refining molten steel in vacuum degassing equipment in which powders such as manganese ore and a CaO-based desulfurization agent are heated with a flame formed at the leading end of a top blowing lance in the vacuum degassing equipment and are thus thrown from the top blowing lance to the bath surface of the molten steel in a way that enhances not only the yield of the addition of the powders such as manganese ore and a CaO-based desulfurization agent but also the efficiency of heat transfer mediated by the powders.

Solution to Problem

To achieve the above object, the present inventors have carried out extensive studies focusing attentions on the temperature of molten steel, the ingredients in the molten steel, and the change in exhaust dust concentration.

As a result, the present inventors have found that the above object can be attained by optimizing conditions under which manganese ore is thrown to molten steel. In particular, the present inventors have found that it is possible to throw manganese ore at a high yield without causing a decrease in the temperature of molten steel by installing the top blowing lance at a predetermined lance height and by controlling to an appropriate range the dynamic pressure P of the jet flow at the exit of the top blowing lance, the dynamic pressure being calculated from the density of the jet flow ejected from the top blowing lance and the velocity of the jet flow at the exit of the top blowing lance.

Further, the present inventors have confirmed that it is possible to perform desulfurization efficiently without causing a decrease in the temperature of molten steel by throwing a CaO-based desulfurization agent, similarly to the throwing of manganese ore, while locating the top blowing lance at a predetermined lance height and while controlling to an appropriate range the dynamic pressure P, calculated as described above, of the jet flow at the exit of the top blowing lance.

The present disclosure has been made based on the above findings. Exemplary disclosed embodiments are described below.

[1] A method for refining molten steel in vacuum degassing equipment, including the steps of:

throwing a powder together with a carrier gas toward a bath surface of molten steel in a vacuum vessel of the vacuum degassing equipment through a central hole disposed at a central portion of a top blowing lance vertically movable in the vacuum vessel; and supplying a hydrocarbon gas from a fuel ejection hole disposed on periphery of the central hole and supplying an oxygen-containing gas from an oxygen-containing gas ejection hole disposed on the periphery, such that the powder falls on the molten steel while being heated with a flame formed by combustion of the hydrocarbon gas at a leading end of the top blowing lance;

wherein a lance height of the top blowing lance is 1.0 to 7.0 m, the lance height being a distance between a static surface of the bath surface and the leading end during the throwing of the powder, a dynamic pressure P of a jet flow ejected from the top blowing lance is calculated from equations (1) to (5) below being 20.0 kPa or more and 100.0 kPa or less, $$P=\rho_g\times U^2/2 \quad (1)$$

$$\rho_g=\rho_A\times F_A/F_T+\rho_B\times F_B/F_T+\rho_C\times F_C/F_T+V_P/(F_T/60) \quad (2)$$

$$U=(F_T/S_T)\times(1/3600) \quad (3)$$

$$S_T=S_A+S_B+S_C \quad (4)$$

$$F_T=F_A+F_B+F_C \quad (5)$$

where, in the equations (1) to (5), P is the dynamic pressure (kPa) of the jet flow at an exit of the top blowing lance, $\rho_g$ is the density (kg/Nm$^3$) of the jet flow, $\rho_A$ is the density (kg/Nm$^3$) of the carrier gas, $\mu_B$ is the density (kg/Nm$^3$) of the oxygen-containing gas, $\rho_C$ is the density (kg/Nm$^3$) of the hydrocarbon gas, $V_P$ is the supply rate (kg/min) of the powder, U is the velocity (m/sec) of the jet flow at the exit of the top blowing lance, $S_T$ is the total of the sectional areas (m$^2$) of the central hole, the fuel ejection hole and the oxygen-containing gas ejection hole at the exit of the top blowing lance, $S_A$ is the sectional area (m$^2$) of the central hole at the exit of the top blowing lance, $S_B$ is the sectional area (m) of the oxygen-containing gas ejection hole at the exit of the top blowing lance, $S_C$ is the sectional area (m$^2$) of the fuel ejection hole at the exit of the top blowing lance, $F_T$ is the total of the flow rates (Nm$^3$/h) of the carrier gas, the oxygen-containing gas and the hydrocarbon gas, $F_A$ is the flow rate (Nm$^3$/h) of the carrier gas, $F_B$ is the flow rate (Nm$^3$/h) of the oxygen-containing gas, and $F_C$ is the flow rate (Nm$^3$/h) of the hydrocarbon gas.

[2] The method described in [1], wherein the powder is one, or two or more of manganese ores, manganese ferroalloys and CaO-based desulfurization agents.

[3] The method described in [1] or [2], wherein the degree of vacuum in the vacuum vessel during the throwing of the powder is 2.7 to 13.3 kPa.

Advantageous Effects

Since the present disclosure controls the lance height of the top blowing lance and the dynamic pressure P of the jet flow ejected from the top blowing lance to appropriate ranges, it is possible to add a powder to the molten steel with a high yield. Consequently, the refining reaction is promoted. Further, because the powder can be added to the molten steel with a high yield, high heat transfer efficiency can be attained. Thus, low-carbon high-manganese steel or ultralow-sulfur steel can be smelted with high productivity and low cost.

BRIEF DESCRIPTION OF DRAWING

FIG. 1 is a schematic vertical sectional view of an example RH vacuum degassing apparatus used in the implementation of the present disclosure.

DESCRIPTION OF EMBODIMENTS

Hereinafter, a molten steel refining method according to the present disclosure will be described in detail. The vacuum degassing equipment usable in the molten steel refining method of the disclosure includes an RH vacuum degassing apparatus, a DH vacuum degassing apparatus, a VAD furnace and a VOD furnace. The most typical equipment is an RH vacuum degassing apparatus. Thus, embodiments of the present disclosure will be described taking as an example the refining of molten steel by the method of the disclosure using an RH vacuum degassing apparatus.

FIG. 1 is a schematic vertical sectional view of an example RH vacuum degassing apparatus used in the implementation of the molten steel refining method of the present disclosure. In FIG. 1, numeral 1 represents an RH vacuum degassing apparatus, 2 a ladle, 3 molten steel, 4 slag, 5 a vacuum vessel, 6 an upper vessel, 7 a lower vessel, 8 an ascending immersion pipe, 9 a descending immersion pipe, 10 a circulation gas blowing pipe, 11 a duct, 12 a charging port, and 13 a top blowing lance. The vacuum vessel 5 is composed of the upper vessel 6 and the lower vessel 7. The top blowing lance 13 is vertically movable in the inside of the vacuum vessel 5.

The RH vacuum degassing apparatus 1 lifts the ladle 2 with an elevator (not shown) so that the ascending immersion pipe 8 and the descending immersion pipe 9 are immersed into the molten steel 3 in the ladle. A circulation gas is then blown through the circulation gas blowing pipe 10 into the ascending immersion pipe 8, and the inside of the vacuum vessel 5 is evacuated with exhaust equipment (not shown) connected to the duct 11 to reduce the pressure inside the vacuum vessel 5. When the inside of the vacuum vessel 5 has been evacuated, the molten steel 3 in the ladle ascends the ascending immersion pipe 8 together with the circulation gas due to the gas lift effect of the circulation gas blown from the circulation gas blowing pipe 10, and flows into the inside of the vacuum vessel 5 and then flows back or circulates to the ladle 2 through the descending immersion pipe 9. RH vacuum degassing refining is thus performed.

Although not shown, the top blowing lance 13 is a multiple tube structure which has independent flow channels including a powder flow channel through which a powder such as manganese ore, manganese ferroalloy or CaO-based desulfurization agent is supplied together with a carrier gas, a fuel flow channel through which a hydrocarbon gas is supplied, an oxygen-containing gas flow channel through which an oxygen-containing gas for combusting the hydrocarbon gas is supplied, and supply and drain channels through which cooling water for cooling the top blowing lance 13 is supplied and drained. The powder flow channel is continuous to a central hole disposed at a central portion of the leading end of the top blowing lance 13. The fuel flow channel is continuous to a fuel ejection hole disposed on periphery of the central hole. The oxygen-containing gas flow channel is continuous to an oxygen-containing gas ejection hole disposed on periphery of the central hole. The cooling water supply and drain channels are connected to each other at the leading end of the top blowing lance 13 and are thus configured to cause the cooling water to return at the leading end of the top blowing lance 13.

The fuel ejection hole and the oxygen-containing gas ejection hole are configured so that the jets from the respective holes will join together. Thus, the hydrocarbon gas ejected through the fuel ejection hole is combusted by the oxygen-containing gas (oxygen gas (industrial pure oxygen gas), oxygen-rich air, air or the like) ejected through the oxygen-containing gas ejection hole to form a burner flame below the leading end of the top blowing lance 13. In this case, an ignition pilot burner may be disposed at the leading end of the top blowing lance 13 to help ignition.

The top blowing lance 13 is connected to a hopper (not shown) which stores a powder such as manganese ore, manganese ferroalloy or CaO-based desulfurization agent, and the powder is supplied together with a carrier gas into the top blowing lance 13 and is ejected from the central hole at the leading end of the top blowing lance 13. The carrier gas for the powder is usually an inert gas such as argon gas or nitrogen gas. When vacuum decarburization refining of the molten steel 3 is performed as is the case in the smelting of low-carbon high-manganese steel, an oxygen-containing gas may be used as the carrier gas. Needless to mention, the lance is configured to suspend the ejection of the powder and to eject the inert gas or the oxygen-containing gas alone.

The top blowing lance 13 is also connected to a fuel supply pipe (not shown) and an oxygen-containing gas supply pipe (not shown). A hydrocarbon gas such as propane gas or natural gas is supplied to the top blowing lance 13 through the fuel supply pipe, and an oxygen-containing gas for combusting the hydrocarbon gas is supplied to the top blowing lance 13 through the oxygen-containing gas supply pipe. As mentioned earlier, the top blowing lance 13 is configured so that the hydrocarbon gas and the oxygen-containing gas are ejected from the fuel ejection hole and the oxygen-containing gas ejection hole, respectively, disposed at the leading end of the lance.

For example, the fuel flow channel and the oxygen-containing gas flow channel in the top blowing lance 13 may be a double pipe in which the inner pipe is the flow channel for the hydrocarbon gas and the outer pipe is the flow channel for the oxygen-containing gas for combusting the hydrocarbon gas (a plurality of such double pipes are disposed on periphery of the central hole). Alternatively, the flow channel for the hydrocarbon gas may be constructed of a single pipe disposed outside the powder flow channel, and the flow channel for the oxygen-containing gas may be constructed of a single pipe disposed further outside.

With the use of the RH vacuum degassing apparatus 1 configured as described above, the powder is ejected from the top blowing lance 13 while being heated with a flame formed by the combustion of the hydrocarbon gas below the leading end of the top blowing lance 13, and is thrown (blown) toward the bath surface of the molten steel 3 circulating in the vacuum vessel 5. In this process, the lance height of the top blowing lance 13 (the distance between the static bath surface of the molten steel and the leading end of the lance) during the throwing of the powder is controlled to 1.0 to 7.0 m, and the dynamic pressure P of the jet flow ejected from the top blowing lance 13 is controlled to 20.0 kPa or more and 100.0 kPa or less, the dynamic pressure being calculated from equations (1) to (5) below:

$$P=\rho_g\times U^2/2 \tag{1}$$

$$\rho_g=\rho_A\times F_A/F_T+\rho_B\times F_B/F_T+\rho_C\times F_C/F_T+V_P/(F_T/60) \tag{2}$$

$$U=(F_T/S_T)\times(1/3600) \tag{3}$$

$$S_T=S_A+S_B+S_C \tag{4}$$

$$F_T=F_A+F_B+F_C \tag{5}$$

In equations (1) to (5), P is the dynamic pressure (kPa) of the jet flow at the exit of the top blowing lance, $\rho_g$ the density (kg/Nm$^3$) of the jet flow, $\rho_A$ the density (kg/Nm$^3$) of the carrier gas, $\rho_B$ the density (kg/Nm$^3$) of the oxygen-containing gas, $\rho_C$ the density (kg/Nm$^3$) of the hydrocarbon gas, $V_P$ the supply rate (kg/min) of the powder, U the velocity (m/sec) of the jet flow at the exit of the top blowing lance, $S_T$ the total of the sectional areas (m$^2$) of the central hole, the fuel ejection hole and the oxygen-containing gas ejection hole at the exit of the top blowing lance, $S_A$ the sectional area (m$^2$) of the central hole at the exit of the top blowing lance, $S_B$ the sectional area (m$^2$) of the oxygen-containing gas ejection hole at the exit of the top blowing lance, $S_C$ the sectional area (m$^2$) of the fuel ejection hole at the exit of the top blowing lance, $F_T$ the total of the flow rates (Nm$^3$/h) of the carrier gas, the oxygen-containing gas and the hydrocarbon gas, $F_A$ the flow rate (Nm$^3$/h) of the carrier gas, $F_B$ the flow rate (Nm$^3$/h) of the oxygen-containing gas, and $F_C$ the flow rate (Nm$^3$/h) of the hydrocarbon gas.

The "jet flow ejected from the top blowing lance 13" is the collection of the powder that is thrown, the carrier gas for the powder, the hydrocarbon gas and the oxygen-containing gas for combusting the hydrocarbon gas, all being considered as a single jet flow. The "static bath surface of the molten steel" is the surface of the molten steel which is exposed to the vacuum atmosphere and which is calm without any gas such as oxygen gas blown thereto. Specifically, in the case of the RH vacuum degassing apparatus 1, the static bath surface of the molten steel is the surface of the molten steel 3 circulating in the vacuum vessel 5.

If the degree of vacuum inside the vacuum vessel 5 is too high, more powder is discharged from the vacuum vessel 5 together with the exhaust gas that is drawn into the duct 11. To prevent this, it is preferable that when the throwing of powder takes place, the degree of vacuum inside the vacuum vessel 5 be 2.7 to 13.3 kPa.

Hereinafter, there will be described example applications of the molten steel refining method of the present disclosure to the smelting of low-carbon high-manganese steel, low-sulfur steel and ultralow-sulfur steel. First, a method for smelting low-carbon high-manganese steel will be described.

Hot metal tapped from a blast furnace is poured into a holding vessel or a transporting vessel such as a hot metal ladle or a torpedo car, and is transported to a converter where the hot metal is refined by decarburization. Usually, the hot metal is pretreated by treatments such as desulfurization and dephosphorization during this transportation. In an embodiment of the present disclosure, it is preferable that the hot metal be pretreated, in particular, dephosphorized, even in the case where the hot metal requires no pretreatment in view of the ingredient standards for low-carbon high-manganese steel. The reason for this is because the smelting of low-carbon high-manganese steel involves the addition of manganese ore as a cheap manganese source in the decarburization refining in the converter. If dephosphorization is not made preliminarily, the dephosphorization reaction needs to be performed simultaneously with the decarburization reaction during the decarburization refining in the converter. This requires that a great amount of CaO-based flux be added to the converter. As a result, an increased amount of slag is formed and more manganese is distributed to the slag to cause a decrease in the yield of manganese introduced into the molten steel.

The transported hot metal is added into the converter. Thereafter, manganese ore as a manganese source is added to the converter and, if necessary, a small amount of a CaO-based flux such as quicklime is added. The hot metal is then decarburized by top-blowing and/or bottom-blowing oxygen gas so as to form a molten steel having the predetermined chemical composition. The molten steel is then tapped into the ladle 2 without the addition of any deoxidizers such as metallic aluminum and ferrosilicon to the molten steel, namely, the molten steel being in the non-deoxidized state. During this process, a predetermined amount of a cheap manganese ferroalloy such as high-carbon ferromanganese may be added.

As mentioned earlier, a cheap manganese source such as manganese ore or high-carbon ferromanganese is used in the decarburization refining in the converter. Because of this fact, the carbon concentration in the molten steel is inevitably increased. It is, however, preferable that even in this case the carbon concentration in the molten steel after the adjustment of manganese concentration be 0.2 mass % or less. If the carbon concentration in the molten steel exceeds 0.2 mass %, the vacuum decarburization refining in the vacuum degassing equipment in the subsequent step takes a long time and thus causes the productivity to be decreased. Further, the temperature drop of the molten steel associated with the extended time of the vacuum decarburization refining needs to be compensated for by increasing the temperature of the molten steel being tapped, which causes the iron yield to be decreased or results in an increased wear of refractories and a consequent increase in refractory costs. It is therefore preferable that the carbon concentration in the molten steel after the adjustment of manganese concentration be 0.2 mass % or less.

The molten steel 3 tapped from the converter is transported to the RH vacuum degassing apparatus 1. In the RH vacuum degassing apparatus 1, the molten steel 3 in the non-deoxidized state is circulated between the ladle 2 and the vacuum vessel 5. The molten steel 3, which has not been deoxidized, is decarburized under vacuum by the reaction of carbon in the molten steel with dissolved oxygen in the molten steel (C+O=CO) as a result of the molten steel 3 being exposed to the vacuum atmosphere in the vacuum vessel. When the circulation of the molten steel 3 has been started, manganese ore is thrown from the top blowing lance 13 using argon gas as the carrier gas. Immediately before or after the start of the throwing of manganese ore, a hydrocarbon gas and an oxygen-containing gas are ejected from the top blowing lance 13 so as to form a flame below the leading end of the top blowing lance 13. The manganese ore is heated by the heat of the flame and is let fall onto the bath surface of the molten steel.

The manganese ore thrown to the bath surface of the molten steel is reduced by carbon in the molten steel to give rise to an increase in manganese concentration in the molten steel and a decrease in carbon concentration in the molten steel. That is, the manganese ore serves not only as the manganese source for adjusting the chemical composition of the molten steel, but also as a source of oxygen for the decarburization reaction of the molten steel 3.

In the process in which a flame is formed below the leading end of the top blowing lance 13 and manganese ore is thrown from the top blowing lance 13, the lance height of the top blowing lance 13 (the distance between the static bath surface of the molten steel and the leading end of the lance) is controlled to 1.0 to 7.0 m, and the flow rates of the respective gases and the supply rate of the manganese ore are controlled in accordance with the sectional areas of the three ejection holes (the central hole, the fuel ejection hole and the oxygen-containing gas ejection hole) of the top blowing lance 13 so that the dynamic pressure P, calculated from equations (1) to (5), of the jet flow at the exit of the top blowing lance will be 20.0 kPa or more and 100.0 kPa or less.

By controlling the dynamic pressure P of the jet flow at the exit of the top blowing lance to the range of 20.0 kPa to 100.0 kPa, the manganese ore can be heated efficiently and be added efficiently to the molten steel 3. Consequently, the manganese ore can be added with no or little temperature drop of the molten steel 3. Because the manganese ore can be efficiently added to the molten steel 3, the manganese ore can be reduced in a promoted manner and the manganese yield can be enhanced, making it possible to cut down the manufacturing costs of low-carbon high-manganese steel by making use of the cheap manganese source.

When the manganese concentration in the molten steel after the addition of manganese ore alone does not satisfy the standards, high-carbon ferromanganese (carbon content: about 7 mass %) may be added through the top blowing lance 13 while being heated with the flame before the addition of the manganese ore, in accordance with the standard manganese concentration for low-carbon high-manganese steel. Alternatively, a mixed powder of high-carbon ferromanganese and manganese ore may be added through the top blowing lance 13 while being heated with the flame.

When the carbon concentration in the molten steel has reached the ingredient standard after a predetermined time of vacuum decarburization refining, a strong deoxidizer such as metallic aluminum is added from the charging port 12 to the molten steel 3 to lower the concentration of dissolved oxygen in the molten steel (deoxidization). The vacuum decarburization refining is thus terminated. In the case where the molten steel temperature after the termination of the vacuum decarburization refining is lower than the temperature required in consideration of the subsequent step such as, for example, a continuous casting step, the molten steel temperature may be raised by adding metallic aluminum to the molten steel 3 through the charging port 12 and combusting the aluminum in the molten steel while blowing oxygen gas from the top blowing lance 13 onto the bath surface of the molten steel.

After being deoxidized by the addition of a strong deoxidizer, the molten steel 3 is further circulated continuously for several minutes. If the manganese concentration in the molten steel 3 is still below the standards, metallic manganese or low-carbon ferromanganese is added to the molten steel 3 through the charging port 12 during this circulation to adjust the manganese concentration in the molten steel 3. Further, if necessary, ingredient regulators such as aluminum, silicon, nickel, chromium, copper, niobium and titanium are added to the molten steel 3 through the charging port 12 during the circulation to bring the chemical composition of the molten steel to the predetermined range. The pressure inside the vacuum vessel 5 is released to atmospheric pressure. The vacuum degassing refining is thus completed.

Next, a method for smelting low-sulfur steel or ultralow-sulfur steel will be described.

Hot metal tapped from a blast furnace is poured into a holding vessel or a transporting vessel such as a hot metal ladle or a torpedo car, and is transported to a converter where the hot metal is refined by decarburization. The hot metal is pretreated by desulfurization during this transportation. As an additional hot metal pretreatment, dephosphorization is performed where necessary in view of the standard phosphorus concentration in low-sulfur steel or ultralow-sulfur steel to be smelted. In other cases, the dephosphorization may be omitted.

The transported hot metal is added into the converter. Thereafter, manganese ore as a manganese source is added as required to the converter and, if necessary, a small amount of a CaO-based flux such as quicklime is added. The hot metal is then decarburized by top-blowing and/or bottom-blowing oxygen gas so as to form a molten steel having the predetermined chemical composition. The molten steel is then tapped into the ladle 2 without the addition of any deoxidizers such as metallic aluminum and ferrosilicon to the molten steel, namely, the molten steel being in the non-deoxidized state. During this process, a predetermined amount of a cheap manganese ferroalloy such as high-carbon ferromanganese may be added.

The molten steel 3 tapped from the converter is transported to the RH vacuum degassing apparatus 1. In the RH vacuum degassing apparatus 1, where necessary, the molten steel 3 in the non-deoxidized state is decarburized under vacuum by blowing oxygen gas to the molten steel 3 through the top blowing lance 13, thereby controlling the carbon concentration in the molten steel 3. When the carbon concentration in the molten steel has reached the ingredient standard, a strong deoxidizer such as metallic aluminum is added from the charging port 12 to the molten steel 3 to deoxidize the molten steel and lower the concentration of dissolved oxygen in the molten steel. The vacuum decarburization refining is thus terminated.

The vacuum decarburization refining is omitted when the standard carbon concentration of low-sulfur steel or ultralow-sulfur steel to be smelted is attainable without vacuum decarburization refining. When the vacuum decarburization refining is omitted, the molten steel 3 does not need to be left in the non-deoxidized state and may be deoxidized by the addition of metallic aluminum to the molten steel 3 being tapped from the converter to the ladle 2. During this deoxidization, quicklime or CaO-containing flux may be added, together with the metallic aluminum, to the steel being tapped. Preferably, the molten steel 3 tapped to the ladle 2 is transported to the RH vacuum degassing apparatus 1 after a slag modifier such as metallic aluminum is added to the slag 4 floating on the molten steel, and iron oxides such as FeO and manganese oxides such as MnO in the slag are reduced.

In the case where the molten steel temperature after the termination of the vacuum decarburization refining is lower than the temperature required in consideration of the subsequent step such as, for example, a continuous casting step, the molten steel temperature may be raised by adding metallic aluminum to the molten steel 3 through the charging port 12 and combusting the aluminum in the molten steel while blowing oxygen gas from the top blowing lance 13 onto the bath surface of the molten steel. When the molten steel 3 in the non-deoxidized state is subjected to vacuum decarburization refining, the treatment may be performed by throwing manganese ore from the top blowing lance 13 while heating it with the flame, similarly to the aforementioned method for smelting low-carbon high-manganese steel.

The molten steel 3 is thereafter deoxidized with a strong deoxidizer such as metallic aluminum and is subsequently desulfurized by ejecting a CaO-based desulfurization agent through the top blowing lance 13 onto the bath surface of the deoxidized molten steel 3 while the CaO-based desulfurization agent being heated with the flame formed at the leading end of the top blowing lance 13.

When the CaO-based desulfurization agent is thrown from the top blowing lance 13 while a flame being formed below the leading end of the top blowing lance 13, the lance height of the top blowing lance 13 (the distance between the static bath surface of the molten steel and the leading end of the lance) is controlled to 1.0 to 7.0 m, and the flow rates of the respective gases and the supply rate of the CaO-based desulfurization agent are controlled in accordance with the sectional areas of the three ejection holes (the central hole, the fuel ejection hole and the oxygen-containing gas ejection hole) of the top blowing lance 13 so that the dynamic pressure P, calculated from equations (1) to (5), of the jet flow at the exit of the top blowing lance will be 20.0 kPa or more and 100.0 kPa or less.

By controlling the dynamic pressure P of the jet flow at the exit of the top blowing lance to the range of 20.0 kPa to 100.0 kPa, the CaO-based desulfurization agent can be heated efficiently and be added efficiently to the molten steel 3. Consequently, the CaO-based desulfurization agent can be added with no or little temperature drop of the molten steel 3. Because the CaO-based desulfurization agent that has been heated can be efficiently added to the molten steel 3, the desulfurization reaction is promoted and a high desulfurization rate can be obtained. For example, the CaO-based desulfurization agent that is added may be quicklime (CaO) alone, or a mixture of quicklime with 30 mass % or less fluorite ($CaF_2$) or alumina ($Al_2O_3$) (the mixture may be premelted).

When the sulfur concentration in the molten steel 3 has fallen to the predetermined level or under, the throwing of the CaO-based desulfurization agent from the top blowing lance 13 is discontinued and the desulfurization is terminated. Even after the end of the treatment, the molten steel 3 is continuously circulated for several minutes and, during this circulation, ingredient regulators such as aluminum, silicon, nickel, chromium, copper, niobium and titanium are added as required to the molten steel 3 through the charging port 12 to bring the chemical composition of the molten steel to the predetermined range. The pressure inside the vacuum vessel 5 is released to atmospheric pressure. The vacuum degassing refining is thus completed.

As described hereinabove, the appropriate controlling of the lance height of the top blowing lance 13 and the dynamic pressure P of the jet flow ejected from the top blowing lance 13 according to the present disclosure allow the powder to be added to the molten steel 3 with a high yield. Consequently, the refining reaction is promoted and, because the powder can be added to the molten steel 3 with a high yield, high heat transfer efficiency can be attained.

While the examples discussed above illustrate refining with an RH vacuum degassing apparatus, the smelting of steel such as low-carbon high-manganese steel, low-sulfur steel or ultralow-sulfur steel is feasible in accordance with the aforementioned method even with the use of other vacuum degassing equipment such as a DH vacuum degassing apparatus or a VOD furnace.

Example 1

Tests were carried out in which approximately 300 tons of molten steel was refined by vacuum decarburization with use of an RH vacuum degassing apparatus illustrated in FIG. 1 to smelt low-carbon high-manganese steel.

The molten steel in the non-deoxidized state as tapped from the converter had a carbon concentration of 0.03 to 0.04 mass % and a manganese concentration of 0.07 to 0.08 mass %. The concentration of dissolved oxygen in the molten steel at the arrival at the RH vacuum degassing apparatus was 0.04 to 0.07 mass %.

The lance height of the top blowing lance inserted through the top of the vacuum vessel was set to 0.5 to 9.0 m. During the vacuum decarburization refining in the RH vacuum degassing apparatus, LNG (hydrocarbon gas) and oxygen gas (oxygen-containing gas for combusting the hydrocarbon gas) were ejected through the top blowing lance so as to form a burner flame below the leading end of the top blowing lance. After the burner flame had been formed, manganese ore (hereinafter, occasionally written as "Mn ore") was thrown at a supply rate of 200 kg/min in all the tests using argon gas as the carrier gas. The amount of the Mn ore added was 5.0 kg/t of the molten steel in all the tests. During the throwing of the powder, the degree of vacuum in the vacuum vessel was in the range of 1.3 to 17.3 kPa, and the flow rate of argon gas for circulation was 3000 NL/min in all the tests.

The tests evaluate the rate of heat transfer to the molten steel and the manganese (Mn) yield. In order to calculate the dynamic pressure P of the jet flow at the exit of the top blowing lance in equations (1) to (5), parameters thereof were used as followings: the density $\rho_A$ of the carrier gas was 1.5 kg/Nm$^3$, the density $\rho_B$ of the oxygen-containing gas was 2.5 kg/Nm$^3$, the density $\rho_C$ of the hydrocarbon gas was 1.5 kg/Nm$^3$, the supply rate $V_P$ of the powder was 200 kg/min, the sectional area $S_A$ of the central hole at the exit of the top blowing lance was 0.0038 m$^2$, the sectional area $S_B$ of the oxygen-containing gas ejection hole at the exit of the top blowing lance was 0.0006 m$^2$, the sectional area $S_C$ of the fuel ejection hole at the exit of the top blowing lance was 0.0003 m$^2$, the flow rate $F_A$ of the carrier gas was 120 to 1000 Nm$^3$/h, the flow rate $F_B$ of the oxygen-containing gas was 240 to 2200 Nm$^3$/h, and the flow rate $F_C$ of the hydrocarbon gas was 400 Nm$^3$/h.

Table 1 describes the lance height and the operation conditions such as the dynamic pressure P during the vacuum decarburization refining in the tests, and the operation results such as the manganese concentration in the molten steel after the vacuum decarburization refining, the manganese yield and the heat transfer rate. In the remarks in Table 1, "INV. EX." means that the test was within the scope of the present disclosure, and "COMP. EX." outside the scope of the present disclosure. The heat transfer rate described in Table 1 was calculated using equation (6) below.

$$\text{Heat transfer rate (\%)} = \text{Heat(cal) input to molten steel} \times 100 / \text{Total heat(cal) of burner combustion} \quad (6)$$

In equation (6), the heat (cal) input to the molten steel is a portion, of the total heat produced by burner combustion, which was transferred to the molten steel, and the total heat (cal) of burner combustion is the product of the calorific value (cal/Nm$^3$) of the fuel multiplied by the volume (Nm$^3$) of the fuel.

TABLE 1

| Test No. | Amount (kg/t) of Mn ore added | Lance height (m) | Dynamic pressure P (kPa) of jet flow | Vacuum degree (kPa) in vacuum vessel during throwing of Mn ore | Mn concentration (mass %) in molten steel: Before addition of Mn ore | Mn concentration (mass %) in molten steel: After addition of Mn ore | Mn yield (mass %) | Decarburization rate (mass %/min) | Heat transfer rate (%) | Remarks |
|---|---|---|---|---|---|---|---|---|---|---|
| 1 | 5.0 | 6.0 | 17.2 | 1.3 | 0.08 | 0.18 | 44 | 0.0017 | 63 | COMP. EX. |
| 2 | 5.0 | 6.0 | 19.5 | 1.3 | 0.08 | 0.20 | 53 | 0.0019 | 68 | COMP. EX. |
| 3 | 5.0 | 6.0 | 20.8 | 1.3 | 0.07 | 0.24 | 76 | 0.0032 | 81 | INV. EX. |
| 4 | 5.0 | 6.0 | 45.1 | 1.3 | 0.08 | 0.26 | 80 | 0.0033 | 82 | INV. EX. |
| 5 | 5.0 | 6.0 | 99.4 | 1.3 | 0.07 | 0.25 | 80 | 0.0035 | 84 | INV. EX. |
| 6 | 5.0 | 6.0 | 100.6 | 1.3 | 0.07 | 0.21 | 62 | 0.0019 | 71 | COMP. EX. |
| 7 | 5.0 | 6.0 | 119.3 | 1.3 | 0.07 | 0.18 | 49 | 0.0018 | 69 | COMP. EX. |
| 8 | 5.0 | 0.5 | 45.1 | 1.3 | 0.07 | 0.20 | 58 | 0.0020 | 72 | COMP. EX. |
| 9 | 5.0 | 1.0 | 45.1 | 1.3 | 0.08 | 0.26 | 80 | 0.0034 | 83 | INV. EX. |
| 10 | 5.0 | 4.0 | 45.1 | 1.3 | 0.08 | 0.26 | 80 | 0.0035 | 82 | INV. EX. |
| 11 | 5.0 | 7.0 | 45.1 | 1.3 | 0.07 | 0.23 | 71 | 0.0031 | 84 | INV. EX. |
| 12 | 5.0 | 8.0 | 45.1 | 1.3 | 0.08 | 0.21 | 58 | 0.0020 | 71 | COMP. EX. |
| 13 | 5.0 | 9.0 | 45.1 | 1.3 | 0.08 | 0.20 | 53 | 0.0019 | 71 | COMP. EX. |
| 14 | 5.0 | 5.0 | 45.1 | 4.0 | 0.07 | 0.27 | 89 | 0.0021 | 86 | INV. EX. |
| 15 | 5.0 | 5.0 | 45.1 | 6.7 | 0.08 | 0.29 | 93 | 0.0033 | 89 | INV. EX. |
| 16 | 5.0 | 5.0 | 45.1 | 9.3 | 0.07 | 0.27 | 89 | 0.0035 | 87 | INV. EX. |
| 17 | 5.0 | 5.0 | 45.1 | 12.0 | 0.07 | 0.27 | 89 | 0.0018 | 86 | INV. EX. |
| 18 | 5.0 | 5.0 | 45.1 | 14.7 | 0.07 | 0.26 | 84 | 0.0020 | 85 | INV. EX. |
| 19 | 5.0 | 5.0 | 45.1 | 17.3 | 0.08 | 0.25 | 76 | 0.0034 | 84 | INV. EX. |

As shown in Table 1, Tests Nos. 3 to 5, 9 to 11, and 14 to 19, in which the lance height was in the range of 1.0 to 7.0 m and the dynamic pressure P of the jet flow calculated from equations (1) to (5) was in the range of 20.0 to 100.0 kPa, attained a manganese yield of 70 mass % or more and a high heat transfer rate of 80% or more.

In contrast, Tests Nos. 1, 2, 6 to 8, 12 and 13 resulted in a low manganese yield and a low heat transfer rate on account of the dynamic pressure P of the jet flow calculated from equations (1) to (5) being outside the range of 20.0 to 100.0 kPa, or the lance height being outside the range of 1.0 to 7.0 m.

In particular, in Tests Nos. 1, 2, 12 and 13, the dynamic pressure of the jet flow at the bath surface of the molten steel was low due to the lance being excessively high or the dynamic pressure P of the jet flow being low, causing an increased amount of the powder to be discharged through the duct together with the exhaust gas. This is probably the reason for the poor yield of addition.

Further, in Tests Nos. 6 to 8, a mass of scull had been deposited on the inner wall of the vacuum vessel after the termination of the refining. The dynamic pressure of the jet flow at the bath surface of the molten steel was excessively increased because of low lance height or high dynamic pressure P of the jet flow, and consequently the powder was scattered inside the vacuum vessel and attached together with the molten steel onto the refractory inside the vacuum vessel. This is probably the reason for the poor heat transfer rate and the low manganese yield.

In Tests Nos. 14 to 17, in which the powder was thrown under a vacuum degree inside the vacuum vessel in the range of 2.7 to 13.3 kPa, a high heat transfer rate and a high manganese yield were attained as compared to the rest of the inventive examples in Tests Nos. 3 to 5, 9 to 11, 18 and 19. This result is probably ascribed to the fact that controlling the vacuum degree in the vacuum vessel to 2.7 to 13.3 kPa during the throwing of the powder stabilized the circulation of the molten steel and lessened the amount of the powder discharged through the duct together with the exhaust gas.

Example 2

Tests were carried out in which approximately 300 tons of molten steel was desulfurized by the addition of a CaO-based desulfurization agent with use of an RH vacuum degassing apparatus illustrated in FIG. 1 to smelt low-sulfur steel (sulfur concentration: 0.0024 mass % or less).

The molten steel before refining in the RH vacuum degassing apparatus had a carbon concentration of 0.08 to 0.10 mass %, a silicon concentration of 0.1 to 0.2 mass %, an aluminum concentration of 0.020 to 0.035 mass % and a sulfur concentration of 0.0030 to 0.0032 mass %. The temperature of the molten steel was 1600 to 1650° C.

Where necessary, the temperature of the molten steel was measured to examine whether the required temperature of the molten steel had been reached before the addition of the CaO-based desulfurization agent. Here, the "required temperature of the molten steel" is the temperature of molten steel determined in each operation depending on the treatment apparatus and treatment conditions adopted, in consideration of a temperature drop after the lapse of the scheduled treatment time and a temperature drop due to the addition of a CaO-based desulfurization agent. When the temperature of the molten steel was insufficient, a heating treatment was performed in which metallic aluminum was added from the charging port and oxygen gas was blown from the top blowing lance.

Thereafter, metallic aluminum for deoxidization and chemical composition adjustment was added to the molten steel. Next, the lance height of the top blowing lance inserted through the top of the vacuum vessel was set to 0.5 to 9.0 m, and LNG (hydrocarbon gas) and oxygen gas (oxygen-containing gas for combusting the hydrocarbon gas) were ejected through the top blowing lance so as to form a burner flame below the leading end of the top blowing lance. After the burner flame had been formed, a premelted $CaO—Al_2O_3$ desulfurization agent was thrown at a supply rate of 200 kg/min in all the tests using argon gas as the carrier gas. The amount of the premelted $CaO—Al_2O_3$ desulfurization agent added was 1500 kg per charge in all the tests. The flow rate of argon gas for circulation was 3000 NL/min in all the tests.

The tests evaluated the performance based on whether or not low-sulfur steel with a sulfur concentration of 0.0024 mass % or less was smelted. In order to calculate the dynamic pressure P of the jet flow at the exit of the top blowing lance in equations (1) to (5), parameters thereof were used as followings: the density $\rho_A$ of the carrier gas was 1.5 kg/Nm$^3$, the density $\rho_B$ of the oxygen-containing gas was 2.5 kg/Nm$^3$, the density $\rho_C$ of the hydrocarbon gas was 1.5 kg/Nm$^3$, the supply rate $V_P$ of the powder was 200 kg/min, the sectional area $S_A$ of the central hole at the exit of the top blowing lance was 0.0028 m$^2$, the sectional area $S_B$ of the oxygen-containing gas ejection hole at the exit of the top blowing lance was 0.0006 m$^2$, the sectional area $S_C$ of the fuel ejection hole at the exit of the top blowing lance was 0.0003 m, the flow rate $F_A$ of the carrier gas was 50 to 700 Nm$^3$/h, the flow rate $F_B$ of the oxygen-containing gas was 80 to 1400 Nm$^3$/h, and the flow rate $F_C$ of the hydrocarbon gas was 400 Nm$^3$/h.

Table 2 describes the lance height and the operation conditions such as the dynamic pressure P during the vacuum decarburization refining in the tests, and the operation results such as the sulfur concentration in the molten steel after the desulfurization, the evaluation of desulfurization and the heat transfer rate. In the remarks in Table 2, "INV. EX." means that the test was within the scope of the present disclosure, and "COMP. EX." outside the scope of the present disclosure. "Passed" and "Failed" in the desulfurization evaluation column in Table 2 mean that the sulfur concentration in the desulfurized molten steel was 0.0024 mass % or less ("Passed") or was over 0.0024 mass % ("Failed"). The heat transfer rate was calculated using equation (6) described hereinabove.

TABLE 2

| Test No. | Amount (kg) of desulfurization agent added | Lance height (m) | Dynamic pressure P (kPa) of jet flow | S concentration (mass %) in molten steel: Before desulfurization | After desulfurization | Evaluation of desulfurization | Heat transfer rate (%) | Remarks |
|---|---|---|---|---|---|---|---|---|
| 51 | 1500 | 5.0 | 18.5 | 0.0031 | 0.0027 | Failed | 61 | COMP. EX. |
| 52 | 1500 | 5.0 | 19.3 | 0.0032 | 0.0027 | Failed | 68 | COMP. EX, |

TABLE 2-continued

| Test No. | Amount (kg) of desulfurization agent added | Lance height (m) | Dynamic pressure P (kPa) of jet flow | S concentration (mass %) in molten steel: Before desulfurization | After desulfurization | Evaluation of desulfurization | Heat transfer rate (%) | Remarks |
|---|---|---|---|---|---|---|---|---|
| 53 | 1500 | 5.0 | 20.7 | 0.0032 | 0.0021 | Passed | 80 | INV. EX. |
| 54 | 1500 | 5.0 | 72.4 | 0.0030 | 0.0020 | Passed | 87 | INV. EX. |
| 55 | 1500 | 5.0 | 99.2 | 0.0031 | 0.0021 | Passed | 83 | INV. EX. |
| 56 | 1500 | 5.0 | 100.3 | 0.0030 | 0.0025 | Failed | 67 | COMP. EX. |
| 57 | 1500 | 5.0 | 116.5 | 0.0031 | 0.0027 | Failed | 65 | COMP. EX. |
| 58 | 1500 | 0.5 | 72.4 | 0.0030 | 0.0026 | Failed | 63 | COMP. EX. |
| 59 | 1500 | 1.0 | 72.4 | 0.0031 | 0.0020 | Passed | 83 | INV. EX. |
| 60 | 1500 | 4.0 | 72.4 | 0.0030 | 0.0020 | Passed | 85 | INV. EX. |
| 61 | 1500 | 7.0 | 72.4 | 0.0030 | 0.0023 | Passed | 86 | INV. EX. |
| 62 | 1500 | 8.0 | 72.4 | 0.0031 | 0.0026 | Failed | 66 | COMP. EX. |
| 63 | 1500 | 9.0 | 72.4 | 0.0031 | 0.0027 | Failed | 61 | COMP. EX. |

As shown in Table 2, Tests Nos. 53 to 55 and 59 to 61, in which the lance height was in the range of 1.0 to 7.0 m and the dynamic pressure P of the jet flow calculated from equations (1) to (5) was in the range of 20.0 to 100.0 kPa, resulted in successful smelting of the desired low-sulfur steel and attained a high heat transfer rate on the order of 80%.

In contrast, Tests Nos. 51, 52, 56 to 58, 62 and 63 resulted in a low desulfurization rate and a low heat transfer rate on account of the dynamic pressure P of the jet flow calculated from equations (1) to (5) being outside the range of 20.0 to 100.0 kPa, or the lance height being outside the range of 1.0 to 7.0 m.

In particular, in Tests Nos. 51, 52, 62 and 63, the dynamic pressure of the jet flow at the bath surface of the molten steel was low due to the lance being excessively high or the dynamic pressure P of the jet flow being low, causing an increased amount of the powder to be discharged through the duct together with the exhaust gas. This is probably the reason for the poor yield of addition.

Further, in Tests Nos. 56, 57 and 58, a mass of scull had been deposited on the inner wall of the vacuum vessel after the termination of the refining. The dynamic pressure of the jet flow at the bath surface of the molten steel was excessively increased because of low lance height or high dynamic pressure P of the jet flow, and consequently the powder was scattered inside the vacuum vessel and attached together with the molten steel onto the refractory inside the vacuum vessel. This is probably the reason for the poor desulfurization rate and the low heat transfer rate.

REFERENCE SIGNS LIST

1 RH VACUUM DEGASSING APPARATUS
2 LADLE
3 MOLTEN STEEL
4 SLAG
5 VACUUM VESSEL
6 UPPER VESSEL
7 LOWER VESSEL
8 ASCENDING IMMERSION PIPE
9 DESCENDING IMMERSION PIPE
10 CIRCULATION GAS BLOWING PIPE
11 DUCT
12 CHARGING PORT
13 TOP BLOWING LANCE

The invention claimed is:

1. A method for refining molten steel in vacuum degassing equipment, the method comprising:

throwing a powder and a carrier gas toward a bath surface of molten steel in a vacuum vessel of the vacuum degassing equipment through a central hole, the central hole being disposed at a central portion of a top blowing lance that is vertically movable in the vacuum vessel; and supplying a hydrocarbon gas from a fuel ejection hole disposed on a periphery of the central hole and supplying an oxygen-containing gas from an oxygen-containing gas ejection hole disposed on the periphery of the central hole, such that the powder falls on the molten steel while being heated with a flame formed by combustion of the hydrocarbon gas at a leading end of the top blowing lance, wherein:

a lance height of the top blowing lance is 1.0 to 7.0 m, the lance height being a distance between a static surface of the bath surface and the leading end during the throwing of the powder, a dynamic pressure P of a jet flow ejected from the top blowing lance is calculated from equations (1) to (5) below such that P is 20.0 kPa or more and 100.0 kPa or less, $$P=\rho_g\times U^2/2 \quad (1)$$

$$\rho_g=\rho_A\times F_A/F_T+\rho_B\times F_B/F_T+\rho_C\times F_C/F_T+V_P/(F_T/60) \quad (2)$$

$$U=(F_T/S_T)\times(1/3600) \quad (3)$$

$$S_T=S_A+S_B+S_C \quad (4)$$

$$F_T=F_A+F_B+F_C \quad (5)$$

where, in the equations (1) to (5),

P is the dynamic pressure (kPa) of the jet flow at an exit of the top blowing lance, $\rho_g$ is the density (kg/Nm$^3$) of the jet flow, $\rho_A$ is the density (kg/Nm$^3$) of the carrier gas, $\rho_B$ is the density (kg/Nm$^3$) of the oxygen-containing gas, $\rho_C$ is the density (kg/Nm$^3$) of the hydrocarbon gas, $V_P$ is the supply rate (kg/min) of the powder, U is the velocity (m/sec) of the jet flow at the exit of the top blowing lance, $S_T$ is the total of the sectional areas (m$^2$) of the central hole, the fuel ejection hole and the oxygen-containing gas ejection hole at the exit of the top blowing lance, $S_A$ is the sectional area (m$^2$) of the central hole at the exit of the top blowing lance, $S_B$ is the sectional area ($m^2$) of the oxygen-containing gas ejection hole at the exit of the top blowing lance, $S_C$ is the sectional area ($m^2$) of the fuel ejection hole at the exit of the top blowing lance, $F_T$ is the total of the flow rates ($Nm^3/h$) of the carrier gas, the oxygen-containing gas and the hydrocarbon gas, $F_A$ is the flow rate ($Nm^3/h$) of the carrier gas, $F_B$ is the flow rate ($Nm^3/h$) of the oxygen-containing gas, and $F_C$ is the flow rate ($Nm^3/h$) of the hydrocarbon gas.

2. The method according to claim 1, wherein the powder includes one or more of manganese ores, manganese ferroalloys and CaO-based desulfurization agents.

3. The method according to claim 1, wherein a degree of vacuum in the vacuum vessel during the throwing of the powder is 2.7 to 13.3 kPa.

4. The method according to claim 2, wherein a degree of vacuum in the vacuum vessel during the throwing of the powder is 2.7 to 13.3 kPa.

* * * * *